US007443408B2

(12) United States Patent
Tozaki

(10) Patent No.: US 7,443,408 B2
(45) Date of Patent: Oct. 28, 2008

(54) THERMAL PRINTER

(75) Inventor: Shuji Tozaki, Chiba (JP)

(73) Assignee: Seiko Instruments Inc. (JP)

( * ) Notice: Subject to any disclaimer, the term of this patent is extended or adjusted under 35 U.S.C. 154(b) by 74 days.

(21) Appl. No.: 11/705,668

(22) Filed: Feb. 13, 2007

(65) Prior Publication Data

US 2007/0222850 A1 Sep. 27, 2007

(30) Foreign Application Priority Data

Mar. 23, 2006 (JP) ..... 2006-080389

(51) Int. Cl.
*B41J 25/304* (2006.01)

(52) U.S. Cl. ..... 347/197

(58) Field of Classification Search ..... 347/197, 347/198, 222, 171, 208
See application file for complete search history.

(56) References Cited

U.S. PATENT DOCUMENTS 5,366,302 A * 11/1994 Masumura et al. ..... 400/120.16
5,694,159 A * 12/1997 Kajiya et al. ..... 347/197

* cited by examiner

*Primary Examiner*—K. Feggins
(74) *Attorney, Agent, or Firm*—Adams & Wilks

(57) ABSTRACT

Provided is a thermal printer including: a thermal head having a plurality of heating elements; a head support member, which is conductive, for supporting the thermal head; a platen roller whose circumferential surface can be brought into contact with the thermal head while nipping a recording paper; biasing members, which are conductive, provided between the case and the head support member, for supporting the head support member while imparting bias toward the platen roller; and a flexible substrate electrically connected with the thermal head to transmit a signal, in which a part of the biasing member extends through the flexible substrate and is grounded by fixation while being electrically connected by solder with respect to the flexible substrate.

10 Claims, 3 Drawing Sheets

THERMAL PRINTER

BACKGROUND OF THE INVENTION

1. Field of the Invention

The present invention relates to a thermal printer incorporated in various kinds of portable information equipment, for performing printing by pressing a heat-generating thermal head against a recording paper.

2. Description of the Related Art

As to a thermal printer mounted to a portable information terminal or the like, for performing printing by pressing a heated thermal head against a special recording paper whose color changes when applied with heat, various models are currently on the market in large quantity. In particular, such the thermal printer is suitably used for printing various kinds of labels, receipts, tickets, and the like because the thermal printer can print characters with smooth outlines as well as multicolor graphics without using toner, ink, or the like.

In general, the thermal printer includes a thermal head having a plurality of heating elements, ahead support member for supporting the thermal head, a platen roller for nipping the recording paper with the thermal head, a motor for delivering the recording paper by rotating the platen roller through a gear, and biasing members (such as coil spring or leaf spring) for pressing the thermal head against the recording paper and the platen roller side.

In a case of performing printing, the thermal head is pressed against the recording paper while the recording paper is being delivered through rotation of the platen roller by the motor. Accordingly, the printings as described above can be performed. In recent years, there is provided a thermal printer employing a thermal line dot method, which enables a silent high-speed printing.

Incidentally, the thermal head and the recording paper are constantly in contact with each other, and during printing in particular, the thermal head and the recording paper cause friction, so electrostatic is accumulated in the thermal head. Thus, in order to let out the electrostatic, it is necessary to mount a dedicated conducting component for electric conduction. In general, a metal plate, metal coil spring, or the like has been employed as the conducting component, and one end side of the conducting component is mechanically brought into press contact with the head support member or the biasing member electrically connected with the thermal head, to thereby electrically connect the other end side thereof to a casing or a flexible substrate (i.e., circuit board for activating the thermal head or the like). Accordingly, the conducting component of the thermal head can be grounded to prevent the electrostatic from accumulating in the thermal head. Thus, the conducting component is as an essential component in a thermal printer.

However, the conventional thermal printer still has the following problems.

That is, the conducting component must be prepared only for preventing accumulation of the electrostatic in the thermal head, and assembling of the thermal printer must be performed with careful attention to the conducting component. Accordingly, production thereof requires much time and effort and costs for the conducting components have been required, thereby leading to an increase in cost and difficulty in efficient production.

SUMMARY OF THE INVENTION

The present invention has been made in view of the above-mentioned circumstances, and an object of the present invention is to provide a thermal printer which enables electrostatic to be positively let out without a provision of a dedicated conducting component which is an essential component in a conventional thermal printer, enables efficient production without requiring much time and effort, and enables a reduction in cost.

To achieve the above-mentioned objects, the present invention provides the following means.

According to the present invention, there is provided a thermal printer including: a case having a pair of side wall portions provided opposed to each other in a width direction of a recording paper; a thermal head extended in the width direction of the recording paper, having a plurality of heating elements; a head support member, which is conductive, for supporting the thermal head; a platen roller whose circumferential surface can be brought into contact with the thermal head while nipping the recording paper, and which is rotatably supported between the pair of side wall portions; a driving means for rotating the platen roller to thereby deliver the recording paper; biasing members, which are conductive, provided between the case and the head support member, for supporting the head support member while imparting bias toward the platen roller; and a flexible substrate whose surface is provided with a wiring pattern, and which is electrically connected with the thermal head to transmit a signal, in which a part of the biasing member extends through the flexible substrate and is grounded by fixation while being electrically connected by solder with respect to the flexible substrate.

In the thermal printer according to the present invention, the recording paper is delivered toward one direction while being nipped between the circumferential surface of the platen roller and the thermal head by rotating the platen roller through activation of the driving means. Also, concurrent with the delivery, various signals are transmitted to the thermal head through the wiring pattern formed on the flexible substrate to activate the thermal head. Accordingly, the plurality of heating elements suitably generate heat. Further, the thermal head is positively pressed against the recording paper because the thermal head is biased toward the platen roller by the biasing members through the head support member. Thus, various characters, figures, and the like can be clearly printed with respect to the delivered recording paper.

Here, both the head support member and the biasing members are conductive, so the thermal head, the head support member, and the biasing members are integrally in a conduction state. In addition, the part of the biasing member extends through the flexible substrate and is grounded while being positively fixed by the solder in an electrically connected state. Accordingly, the electrostatic accumulated in the thermal head can be immediately let out through the flexible substrate, and damage or the like due to the electrostatic can be prevented.

In particular, the electrostatic is let out using the part of the biasing member, so a dedicated conducting component for letting out the electrostatic, which is an essential component in the conventional thermal printer, is unnecessary. Therefore, number of components can be reduced to suppress cost increase, and an assembling time can be shortened.

As described above, according to the thermal printer of the present invention, the electrostatic can be positively let out without the provision of the dedicated conducting component essential to the conventional thermal printer, efficient production can be realized without requiring much time and effort, and a reduction in cost can be achieved.

In addition, the part of the biasing member and the flexible substrate are not only in press contact in a mechanical manner as in the conventional case, but are fixed positively by the solder. Thus, electrical connection between the biasing member and the flexible substrate can be positively maintained for a long period of time, and the conduction state is not interrupted even when vibration or the like is applied during printing. As described above, the conduction state can be stably maintained, so malfunctions due to the electrostatic can be positively prevented from being generated, thereby improving reliability.

Further, according to the present invention, there is provided a thermal printer in which: the biasing member comprises a coil spring in which a linear member is extended in spiral from a side of the case toward a side of the head support member; and a terminal of the linear member on the side of the case extends through the flexible substrate and is fixed by the solder.

In the thermal printer according to the present invention, there are provided coil springs between the case and the head support member to bias the thermal head toward the platen roller side using elastic force. The terminal on the case side among the two terminals of the spirally formed linear member extends through the flexible substrate and is fixed by the solder. By thus connecting the part of the linear member (i.e., part of the biasing member) with the flexible substrate, the coil spring itself can be used as a conductive circuit even without the provision of the dedicated conducting component.

In addition, the coil spring imparts bias to the thermal head. However, the linear member hardly moves even when vibration or the like is applied during printing since the part of the coil spring on the case side is a fixed side, unlike the part of the coil spring on the head support member side. The terminal of the linear member positioned on the case side is connected to the flexible substrate, so external force such as vibration can be prevented from being transmitted to the fixed portion fixed by the solder as much as possible. Thus, a fixed state by the solder can be stably maintained for a long period of time. As a result, conductive paths through which the electrostatic passes can be secured in a more stable manner.

In addition, according to the present invention, there is provided a thermal printer in which the linear member is fixed to a surface of the flexible substrate in a state where the linear member is brought into line contact with the flexible substrate for a predetermined length.

In the thermal printer according to the present invention, the linear member and the flexible substrate are not only in point contact with each other and fixed by the solder, but also are in line contact with each other for a predetermined length and fixed by the solder. Therefore, a contacting area of the linear member and the flexible substrate can be increased, thereby securing fixation by the solder to a greater extent.

Further, in fixing with the solder, the linear member and the flexible substrate can be kept still in a stable manner while bringing both components in contact with each other, so soldering is performed with ease and the fixing operation is facilitated. Thus, the assembling operation can be performed with efficiency.

Further, according to the present invention, there is provided a thermal printer in which a protrusion and a recess, which form a positioning portion, for positioning the coil spring are respectively formed in the case and the head support member.

In the thermal printer according to the present invention, the case and the head support member are respectively provided with a protrusion and a recess which form a positioning portion, so the coil spring can be easily and positively mounted at the predetermined position between the case and the head support member. Further, after mounting, positional shift of the coil springs can be prevented from occurring. Accordingly, the assembling operation can be simplified and unnecessary external force can be prevented from being applied to the fixed portion fixed by the solder as much as possible.

Further, according to the present invention, there is provided a thermal printer in which a surface of the biasing member is coated with a nickel plate.

In the thermal printer according to the present invention, the surface of the biasing member is coated with the nickel plate (by plating processing), so "spreadability" of the solder, that is, the attaching property thereof is improved. Thus, fixing operation of the biasing member and the flexible substrate can be performed with ease, and the fixed state thereof can be strengthened. Further, conductivity can be increased, so the electrostatic accumulated in the thermal head can be efficiently let out through the flexible substrate. Accordingly, malfunctions due to the electrostatic can be positively prevented from occurring.

In the thermal printer according to the present invention, the electrostatic can be positively let out without the provision of the dedicated conducting component essential in the conventional thermal printer, efficient production can be achieved without requiring much time and effort, and further reduction in cost can be attained.

DETAILED DESCRIPTION OF THE PREFERRED EMBODIMENTS

Hereinafter, an embodiment of a thermal printer according to the present invention will be described with reference to FIGS. 1 to 6. It should be noted that in this embodiment, an example of a case where a thermal printer is mounted to a portable information terminal capable of allowing a home-delivery worker to perform card settlement at a client site is described.

Figure 1:
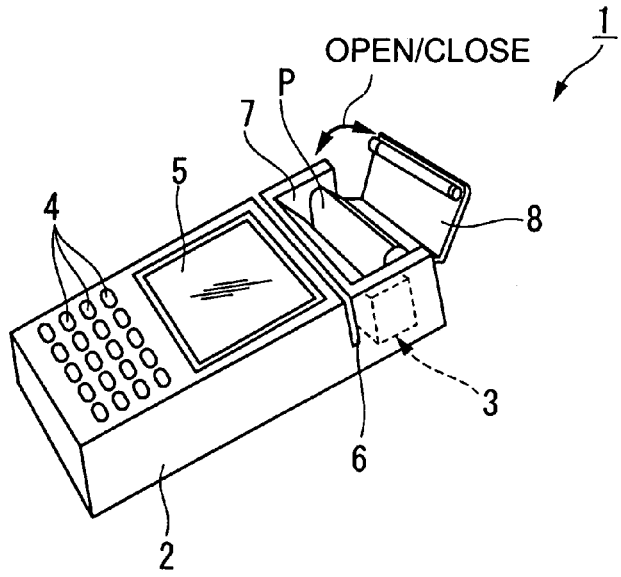
FIG. 1 is an outer perspective view of an information terminal equipped with a thermal printer according to the present invention.

As shown in FIG. 1, an information terminal 1 of this embodiment includes a case body 2, a thermal printer 3 accommodated in the case body 2, an input portion 4 composed of a plurality of key buttons and a liquid crystal display portion 5 for displaying various sorts of information, both of which are provided on a surface of the case body 2, a reading portion 6 for reading data from a magnetic recording portion of a magnetic card (not shown) at a time of insertion of the magnetic card, a recording paper accommodating portion 7 for accommodating a recording paper P wound in a roll, and a cover 8 which supports a platen roller 13 of the thermal printer 3 and is capable of opening and closing with the platen roller 13.

Figure 2:
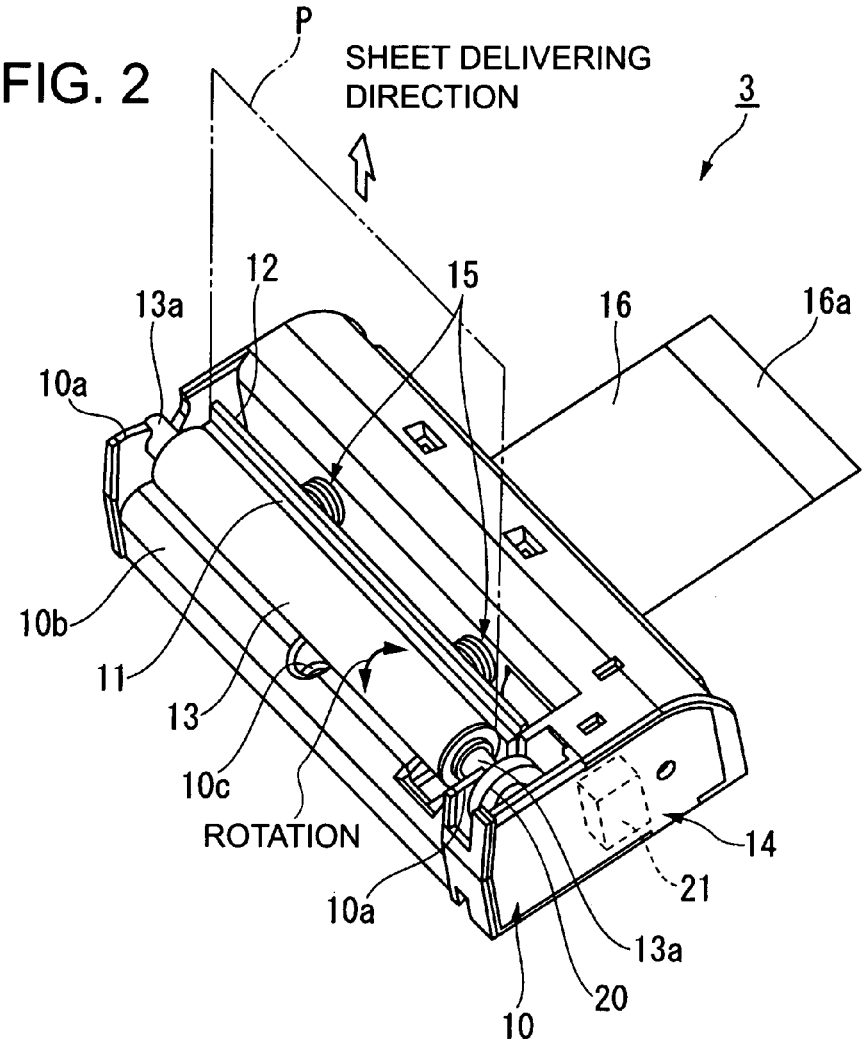
FIG. 2 is an outer perspective view of the thermal printer shown in FIG. 1 as viewed from above.
Figure 3:
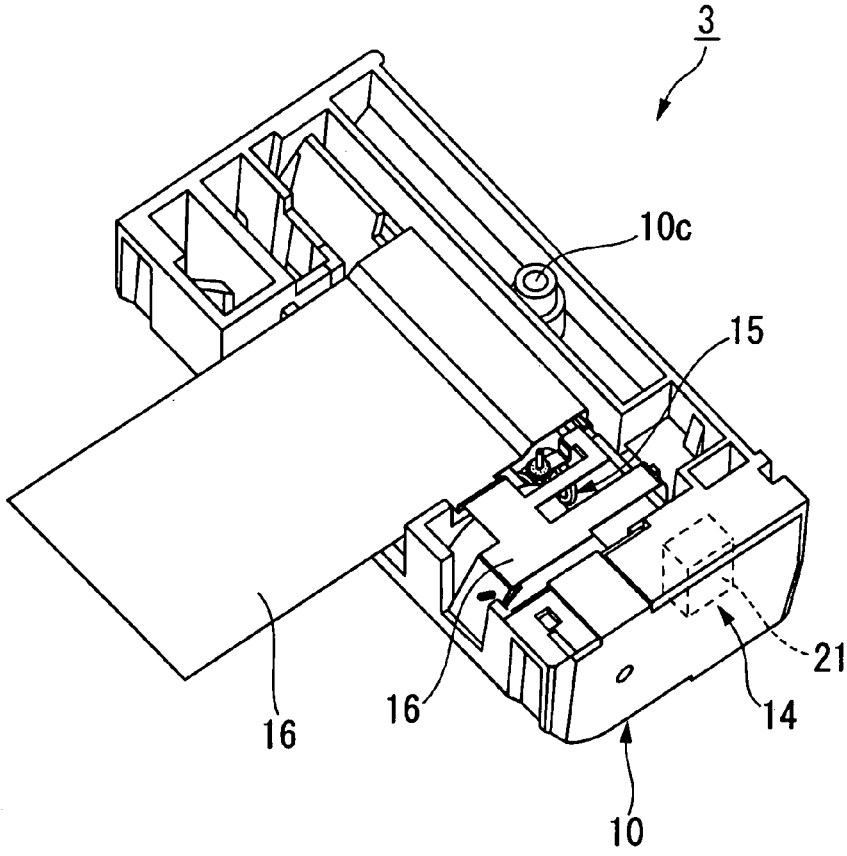
FIG. 3 is an outer perspective view of the thermal printer shown in FIG. 2 as viewed from below.

As shown in FIGS. 2 and 3, the thermal printer 3 includes a frame (i.e., case) 10 having a pair of side wall portions 10*a* provided opposed to each other in a width direction of the recording paper P, a thermal head 11 having a plurality of heating elements and which is extended in the width direction of the recording paper P, a conductive head support member 12 for supporting the thermal head 11, the platen roller 13 whose circumferential surface may be brought into contact with the head support member 12 while nipping the recording paper P therebetween and which is rotatably supported between the pair of side wall portions 10*a*, driving means 14 for rotating the platen roller 13 to deliver the recording paper P, conductive coil springs (biasing members) 15 provided between the frame 10 and the head support member 12, for supporting the head support member 12 in a state where the head support member 12 is biased toward the platen roller 13, and a flexible substrate 16 whose surface is provided with a wiring pattern (not shown) and which is electrically connected to the thermal head 11 to transmit a signal.

The frame 10, which is formed in a substantially rectangular shape, is an injection-molded article of a plastic such as polycarbonate, and is provided with an accommodating portion 10*b* for accommodating the platen roller 13 on an upper surface side thereof as shown in FIG. 2. The pair of side wall portions 10*a* are provided opposed to each other with the accommodating portion 10*b* positioning therebetween. In addition, the frame 10 is mounted to the recording paper accommodating portion 7 in such a manner that the frame 10 is positioned above the recording paper P wound in a roll. In other words, the recording paper P is delivered toward the upper surface side from the lower surface side of the frame 10. It should be noted that the frame 10 is thread-bonded to the case body 2 by using a screw hole 10*c* formed at the center of the accommodating portion 10*b*.

The platen roller 13 is rotatably supported by having both ends 13*a* thereof fitted to grooves of the pair of side wall portions 10*a* when the cover 8 is closed with respect to the case body 2. Further, a driven gear 20 is fixed to one end side of the platen roller 13, so the driven gear 20 is made to intermesh with a gear transmission mechanism (not shown) mounted to the frame 10 side when the platen roller 13 is supported by the pair of side wall portions 10*a*. The gear transmission mechanism is connected to a motor 21 and transmits a rotation drive force from the motor 21 to the driven gear 20. Thus, the platen roller 13 can deliver the recording paper P from the lower surface side to the upper surface side of the frame 10 through rotation while being supported by the pair of side wall portions 10*a*. The gear transmission mechanism and the motor 21 constitute the driving means 14.

Figure 4:
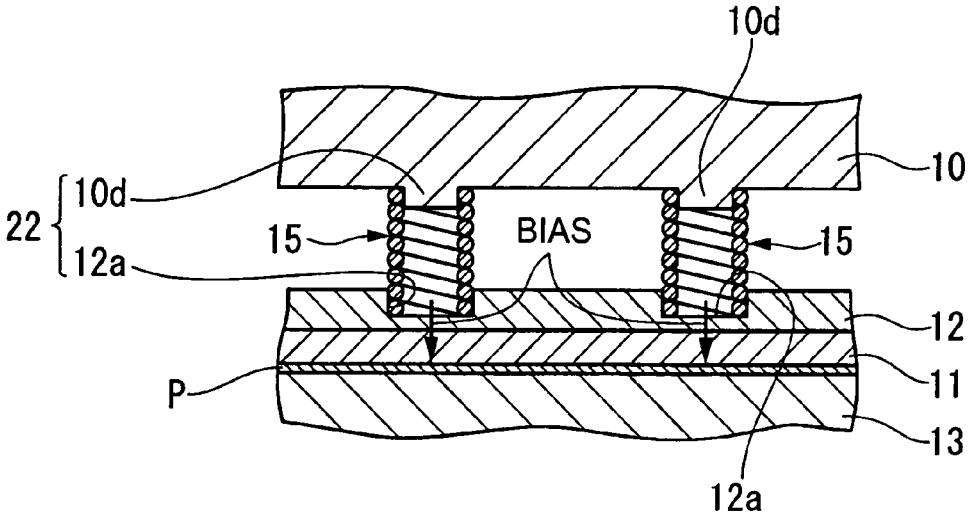
FIG. 4 is an enlarged sectional view showing a periphery of a head support member, coil springs, and a frame constituting the thermal printer.

The thermal head 11 is supported by the head support member 12 while being arranged in opposition to the platen roller 13. In addition, as shown in FIGS. 2 and 4, two coil springs 15 are provided between the head support member 12 and the frame 10, and constantly impart bias to the head support member 12 toward the platen roller 13 side by elastic force. Accordingly, as described above, the circumferential surface of the platen roller 13 is brought into contact with the thermal head 11 while nipping the recording paper P therebetween.

Further, as shown in FIG. 4, protrusions 10*d* and recesses 12*a* for positioning the coil springs 15 are respectively provided to the frame 10 and the head support member 12. In other words, on the surface of the frame 10, there are provided the protrusions 10*d*, each of which is formed with an inner diameter smaller than that of the coil spring 15 and can be fitted to the inner side of the coil spring 15. On the other hand, on the surface of the head support member 12, there are provided the recesses 12*a*, each of which is formed with an outer diameter larger than that of the coil spring 15 and to which the coil spring 15 itself is fitted. The coil spring 15 can be easily and securely mounted to a predetermined position by fitting one end side of the coil spring 15 to the recess 12*a* and by fitting the other end thereof to the protrusion 10*d*. The protrusion 10*d* and the recess 12*a* constitute a positioning portion 22 for positioning the coil spring 15.

Further, as shown in FIG. 3, the flexible substrate 16 is provided in the lower surface side of the frame 10 and the wiring pattern formed on the surface of the flexible substrate 16 is suitably electrically connected to the thermal head 11, the motor 21, and the like. In addition, as shown in FIG. 2, the base end side of the flexible substrate 16 composes a terminal portion 16*a* of the wiring pattern, and the terminal portion 16*a* is connected to a control portion (not shown) of the information terminal 1. Thus, the thermal head 11 and the motor 21 are activated through input of an electric signal, control signal, or the like via the wiring pattern.

Figure 5:
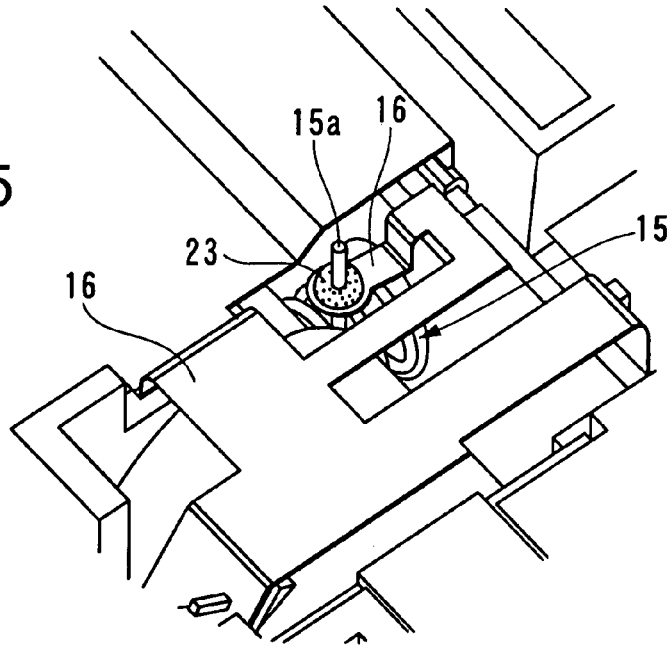
FIG. 5 is an enlarged view of the thermal printer shown in FIG. 3, which illustrates a mounted state of the coil spring and a flexible substrate.
Figure 6:
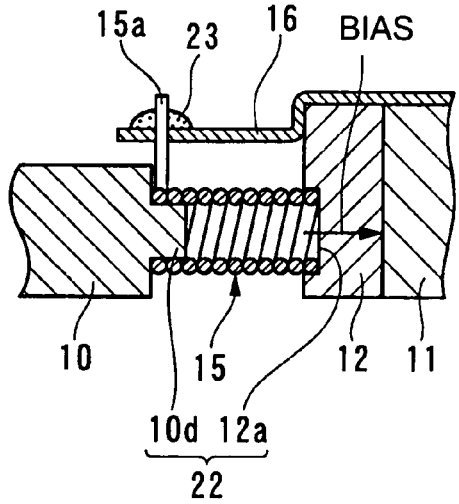
FIG. 6 is a sectional view showing the mounted state of the coil spring and the flexible substrate shown in FIG. 5.

In addition, as shown in FIGS. 5 and 6, a part of the coil spring 15 extends through the flexible substrate 16 and is fixed while being electrically connected therewith by solder 23 so that the coil spring 15 is grounded. In other words, the coil spring 15 is formed so that a linear member 15*a* extends spirally from the frame 10 side to the head support member 12 side. The terminal on the frame 10 side of the two terminals of the linear member 15*a* extends through the flexible substrate 16 and is fixed by the solder 23.

Here, the head support member 12 and the coil spring 15 are both conductive, so the thermal head 11, the head support member 12, and the coil spring 15 are integrally in a conduction state. Accordingly, the thermal head 11 is in a grounded state via the head support member 12, the coil spring 15, and the flexible substrate 16.

A release lever (not shown) for releasing the platen roller 13 from the pair of side wall portions 10*a* is mounted to the thermal printer 3. In addition, the release lever is arranged on the surface of the case body 2 to be exposed to an outside so that the home-delivery worker can operate the release lever manually. Further, by operating the release lever to release the platen roller 13 from the pair of side wall portions 10*a*, the cover 8 is opened together with the platen roller 13 as shown in FIG. 1. Accordingly, when the recording paper P is refilled, for example, the recording paper P can be easily nipped between the platen roller 13 and the thermal head 11.

Next, a case where the home-delivery worker performs card settlement at a client site by using the information terminal 1 thus configured, and where settlement information is printed on the recording paper P by using the thermal printer 3 will be described.

The home-delivery worker who has received a credit card from a client at a delivery site inserts the magnetic card in the card reading portion 6 to read data stored in the magnetic recording portion. Further, the home-delivery worker performs suitable operations using the input portion 4 while confirming various sorts of information displayed on the liquid crystal display portion 5 to thereby complete the card settlement. After completion of the card settlement, the recording paper P is printed with the settlement information.

First, a signal is output from the control portion to the motor 21 through the wiring pattern of the flexible substrate 16 to activate the driving means 14 composed of the motor 21 and the gear transmission mechanism. Due to activation of the driving means 14, the platen roller 13 starts rotating through the driven gear 20. Accordingly, the recording paper P nipped between the circumferential surface of the platen roller 13 and the thermal head 11 is delivered from the lower surface side of the frame 10 to the upper surface side thereof, that is, the upper surface side of the information terminal 1.

In addition, concurrent with the delivery of the recording paper P, a signal is output from the control portion to the thermal head 11 through the wiring pattern of the flexible substrate 16 to activate the thermal head 11. Accordingly, a plurality of heating elements suitably generate heat. At this time, the thermal head 11 is biased toward the platen roller 13 by the coil springs 15 through the head support member 12, so clear printing of various kinds of characters, figures, and the like can be performed with respect to the recording paper P. As a result, settlement information can be printed on the recording paper P.

Here, the thermal head 11 is grounded through the head support member 12, the coil springs 15, and the flexible substrate 16, so even when electrostatic is accumulated by friction with the recording paper P during printing, the electrostatic can immediately escape through the flexible substrate 16. Thus, damage or the like of the thermal head 11 due to the electrostatic can be prevented.

In particular, the electrostatic is let out by using a part of the coil spring 15, so a dedicated conducting component which is an essential component in a conventional thermal printer, for letting out the electrostatic is no longer necessary. In other words, by connecting a part of the linear member 15*a* of the coil spring 15 to the flexible substrate 16, the coil spring 15 itself can be used as a conductive circuit even without the provision of the dedicated conducting component. Accordingly, the number of components can be reduced to suppress cost increase, and an assembling time can be shortened.

In addition, the part of the coil spring 15 and the flexible substrate 16 are not only in press contact with each other in a mechanical manner as in the conventional case, but are in a state where the part of the coil spring 15 and the flexible substrate 16 are securely fixed by the solder 23. Accordingly, electrical connection between the coil spring 15 and the flexible substrate 16 can be positively maintained for a long period of time, and the conduction state is not interrupted even when vibration is applied during printing, for example. As described above, the conduction state can be stably maintained, so malfunctions due to the electrostatic can be positively prevented from occurring to enhance reliability.

Further, the coil spring 15 imparts bias to the thermal head 11. However, because the coil spring 15 on the frame 10 side is a fixed side unlike the coil spring 15 on the head support member 12 side, the linear member 15*a* hardly moves even when vibration or the like is applied thereto during printing. Also, the terminal of the linear member 15*a* positioned on the frame 10 side is connected to the flexible substrate 16, so external force such as vibration can be prevented from being applied to the fixed portion fixed with the solder 23 as much as possible. Thus, conductive paths through which electrostatic passes can be secured in a more stable manner. As can be seen from the above-mentioned points, the electrostatic can be positively and continuously let out for a long period of time to thereby enhance reliability.

In addition, the protrusions 10*d* and the recesses 12*a* forming the positioning portions 22 are respectively formed on the frame 10 and the head support member 12, so the coil springs 15 can be easily and securely mounted to predetermined positions between the frame 10 and the head support member 12. Further, after the mounting, positional shift of the coil springs 15 can be prevented from occurring. Accordingly, an assembling operation can be simplified and unnecessary external force can be prevented from being applied to the fixed portion fixed with the solder 23 as much as possible.

As described above, the thermal printer 3 of this embodiment can let out the electrostatic without the provision of the dedicated conducting component for letting out the electrostatic, which is an essential component in the conventional printer, enables efficient production without requiring much time and effort, and enables further reduction in cost.

It should be noted that the technical range of the present invention is not limited to the above embodiment and various modifications can be additionally made as long as it does not depart from the gist of the present invention.

For example, in the above embodiment, the linear member 15*a* of the coil spring 15 and the flexible substrate 16 are locally fixed while being brought into point contact with each other. However, the present invention is not limited to this case, and the linear member 15*a* of the coil spring 15 and the flexible substrate 16 can be fixed in a state where wider areas thereof are brought into contact with each other.

Figure 7:
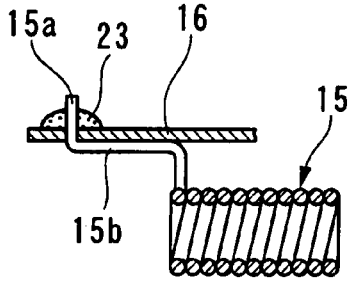
FIG. 7 is a view showing the mounted state of the coil spring, on which a contacting portion to be brought into line contact with the flexible substrate is formed, and the flexible substrate.

For example, as shown in FIG. 7, a contacting portion 15*b* which is brought into line contact with the flexible substrate 16 may be formed by bending a predetermined length of the end of the linear member 15*a* by substantially 90 degrees. Accordingly, the contacting area of the linear member 15*a* and the flexible substrate 16 can be increased to thereby fix both of the components in a more secure manner by the solder 23. In addition, in the case of fixing the components with the solder 23, the linear member 15*a* and the flexible substrate 16 can be kept still in a stable manner while being brought into contact with each other, so the solder 23 is easily applied thereto, which facilitates the fixing operation. Thus, the assembling operation can be performed with higher efficiency.

In addition, the head support member 12 is biased by using the coil springs 15. However, the present invention is not limited to this case and any biasing member may be employed as long as the biasing member imparts bias to the head support member 12. For example, a leaf spring may be employed. Even in this case, a part of the leaf spring may extend through the flexible substrate 16 to be fixed by the solder 23. However, the coil spring 15 is preferably employed because the linear member 15*a* can be used as it is.

Further, the surface of the coil spring 15 is preferably coated with a nickel plate. By coating the surface of the coil spring 15, the "spreadability", that is, the attaching property of the solder 23 enhances. Thus, the fixing operation of the coil spring 15 and the flexible substrate 16 can be facilitated, and the fixed state thereof can be strengthened. Further, conductivity can be enhanced, so electrostatic accumulated in the thermal head 11 can be efficiently let out through the flexible substrate 16. Accordingly, malfunctions due to electrostatic can be positively prevented from occurring.

Further, in the above embodiment, the example in which the thermal printer 3 is mounted to the information terminal 1 is described. However, the present invention is not limited to such the case and can be mounted to various kinds of information equipment such as a facsimile and a laptop personal computer.

What is claimed is:

1. A thermal printer, comprising:

a case having a pair of side wall portions provided opposed to each other in a width direction of a recording paper;

a thermal head extending in the width direction of the recording paper and having a plurality of heating elements;

a head support member, which is conductive, for supporting the thermal head;

a platen roller whose circumferential surface can be brought into contact with the thermal head while nipping the recording paper, and which is rotatably supported between the pair of side wall portions;

a driving means for rotating the platen roller to deliver the recording paper;

biasing members, which are conductive, provided between the case and the head support member, for supporting the head support member while imparting bias toward the platen roller; and a flexible substrate whose surface is provided with a wiring pattern, and which is electrically connected with the thermal head to transmit a signal, wherein a part of the biasing member extends through the flexible substrate and is grounded by fixation while being electrically connected by solder with respect to the flexible substrate.

2. A thermal printer according to claim 1, wherein:

the biasing member comprises a coil spring in which a linear member is extended in spiral from a side of the case toward a side of the head support member; and a terminal of the linear member on the side of the case extends through the flexible substrate and is fixed by the solder.

3. A thermal printer according to claim 2, wherein the linear member is fixed to a surface of the flexible substrate in a state where the linear member is brought into line contact with the flexible substrate by a predetermined length.

4. A thermal printer according to claim 3, wherein a protrusion and a recess, which form a positioning portion, for positioning the coil spring are respectively formed in the case and the head support member.

5. A thermal printer according to claim 4, wherein a surface of the biasing member is coated with a nickel plate.

6. A thermal printer according to claim 3, wherein a surface of the biasing member is coated with a nickel plate.

7. A thermal printer according to claim 2, wherein a protrusion and a recess, which form a positioning portion, for positioning the coil spring are respectively formed in the case and the head support member.

8. A thermal printer according to claim 7, wherein a surface of the biasing member is coated with a nickel plate.

9. A thermal printer according to claim 2, wherein a surface of the biasing member is coated with a nickel plate.

10. A thermal printer according to claim 1, wherein a surface of the biasing member is coated with a nickel plate.

* * * * *